United States Patent [19]

McLaren

[11] 4,202,465

[45] May 13, 1980

[54] DIVIDED FOOD CONTAINER

[75] Inventor: Edwin C. McLaren, Apple Valley, Minn.

[73] Assignee: Champion International Corporation, Stamford, Conn.

[21] Appl. No.: 927,176

[22] Filed: Jul. 21, 1978

[51] Int. Cl.[2] ..... B65D 5/26; B65D 5/56

[52] U.S. Cl. ..... 220/468; 220/23.83; 229/15; 229/28 R; 229/32; 426/114; 426/120

[58] Field of Search ..... 220/20, 410, 23.8, 23.83, 220/23.86, 468, 441; 229/42, 28, 15, 32; 426/107, 113, 114, 234, 120

[56] References Cited

U.S. PATENT DOCUMENTS

| | | | |
|---|---|---|---|
| 1,345,711 | 7/1920 | Shapiro | 229/42 |
| 1,782,915 | 11/1930 | Weidner | 229/42 X |
| 2,391,767 | 12/1945 | Beerend | 220/410 |
| 2,709,904 | 6/1955 | Boughton | 220/23.8 |
| 3,305,124 | 2/1967 | Whiteford | 220/23.8 X |
| 3,759,720 | 9/1973 | Young | 426/114 |
| 3,863,832 | 2/1975 | Gordon et al. | 229/30 |
| 3,993,239 | 11/1976 | Exel | 229/15 X |

*Primary Examiner*—Allan N. Shoap
*Attorney, Agent, or Firm*—Evelyn M. Sommer

[57] ABSTRACT

A container for packaging frozen food in which the food can be reheated including a paperboard tray having upstanding side walls and horizontal flanges and an upright central divider wall forming separate food compartments in the tray. The container is formed from a planar die-cut blank in which the central divider wall is formed by folding adjacent rectangular panels on the blank into abutting, back-to-back relation and the side walls are one piece and are foldably connected to adjacent die-cut portions of the blank so that when the divider wall is erected, the side walls are continguous to each other about the periphery of the tray. A preformed, semi-rigid blister of thermoformable plastic material is used in combination with the tray to provide a leakproof liner.

3 Claims, 6 Drawing Figures

DIVIDED FOOD CONTAINER

BACKGROUND OF THE INVENTION

1. Field of the Invention

This invention relates to a container and, more particularly, to a divided food container used for packaging food during refrigeration which may also be used during the subsequent heating and serving of the packaged food.

2. Description of the Prior Art

There is a demand for a container wherein meals consisting of different foods are packaged and refrigerated for a substantial length of time and subsequently prepared and served within a minimum length of time. Such a container is particularly needed for meals which are to be served on airliners and at institutions such as schools and hospitals, as well as homes wherein food may be reheated in a microwave oven. Separate, premeasured portions of food must be stored in the container under refrigerated conditions for extended periods of time and then quickly reheated and served.

Such a food container must be low in cost, disposable, and adapted to protect the packaged food stored therein under conditions of the extreme temperature variations.

Heretofore, the majority of prior art food containers used for such purposes were made completely from plastic or metal foil. Although metal foil and plastic can be used to form food packaging containers their use has certain disadvantages. For example, the preferred method at present for reheating premeasured food portions disposed in such containers is through the use of microwave ovens. One advantage of microwave ovens is that the food within the container can be heated without necessarily heating the container in which the food is packaged. Thus, the use of metal foil as the packaging material nullifies this advantage in that a microwave oven will heat both the food and the metal food container, making the container difficult to handle. Additionally, the use of metal food containers tends to short circuit microwave radiation, reducing the effectiveness of the oven.

With regard to food containers constructed solely from plastic materials, the material and manufacturing costs for producing a sufficiently rigid container are higher than the material and manufacturing costs associated with the use of paperboard as a container material. The packaging operation by which the food products are sealed in individual containers should be highly automated and should employ low cost materials to reduce packaging costs without reducing the integrity of the package seal. Paperboard is strong and relatively inexpensive and therefore generally suitable for such packaging applications.

It has been found that if a paperboard food container is lined with a continuous sheet of film, such as polypropylene or polyethylene, the film would tend to rigidify the container and further tends to lock flanges formed on such a container in place, which can be associated with a lid for the container. The film has been formed in place after the container has been erected from a paperboard blank which lends the formation of such containers to low cost, mass produced, manufacturing operations.

U.S. Pat. No. 3,932,105, issued Jan. 13, 1976, and assigned to the assignee of the present invention, discloses equipment and a process for lining an erected paperboard food container with a continuous sheet of film. In a preferred embodiment, the film is heated and then drawn into intimate contact with the interior tray walls by applying a vacuum to the exterior bottom wall and exterior side walls of the tray.

U.S. Pat. No. 3,863,832, issued Feb. 4, 1975, illustrates a paperboard food container of the type discussed above, which might be useful in such a manufacturing process. The food packaging container disclosed therein includes a tray and a lid both of which are constructed of paperboard having a thermoplastic coating on at least the interior surface thereof. The tray includes a base portion and a plurality of upstanding walls. The base portion is rectangular with four divergently upstanding walls which are foldably connected to the base portion. The upstanding walls are traversely interconnected by corner closures. Each corner closure is foldably connected to an upstanding wall at one end thereof and is overlappingly bonded to the transverse end of the adjacent upstanding wall. Each of the upstanding walls is foldably connected to a horizontal panel. The ends of the horizontal panels are abutting so as to form a horizontal, peripheral flange. A lid may then be bonded to the peripheral flange to seal food contents placed within the container. In one embodiment, an upstanding central divider wall is provided in the rectangular base portion to provide a pair of discrete compartments for holding different food portions.

SUMMARY OF THE INVENTION

The tray portion of the food container of the present invention is formed from a paperboard blank including a substantially rectangular base, half of which is die cut and scored so as to provide an upright central wall divider on the base when the blank is fully erected.

Connected by score lines to the uncut portion of the base are three upstanding walls which are foldably connected to the base. The upstanding walls are traversely interconnected by corner closures. Each corner closure is foldably connected to an upstanding wall at one end thereof and is overlappingly bonded to the transverse end of an adjacent upstanding wall. Connected to the cut portion of the rectangular base is a fourth upstanding wall. The fourth upstanding wall is connected to the lower edge of the die cut portion of the base by a foldable score line. After the center wall divider is erected, the fourth upstanding wall portion is aligned with corner closures on the adjacent upstanding wall portions connected to the uncut portion of the rectangular base whereby the closures may be foldably connected to the fourth upstanding wall, overlapped, and bonded thereto to quickly and efficiently form the tray or food container with an upright central divider.

Each of the upstanding walls is foldably connected to a horizontal panel. The three horizontal panels connected to the upstanding walls integral with the base along with the horizontal panel connected to the fourth upstanding wall foldably connected to the die cut portion of the base define a peripheral flange for the food container to which a lid may be bonded.

In the described embodiment, the flanges and upstanding walls need not abut intermediate their ends, as in the prior art blanks, but rather each wall and flange is an integral, one-piece element resulting in increased strength of the formed container.

A liner for use in combination with the paperboard tray erected from the described blank comprises a peformed semi-rigid blister of thermoformable plastic material. The blister conforms generally to the tray interior and includes flanges which are sealed to the flanges of the paperboard tray.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 3:
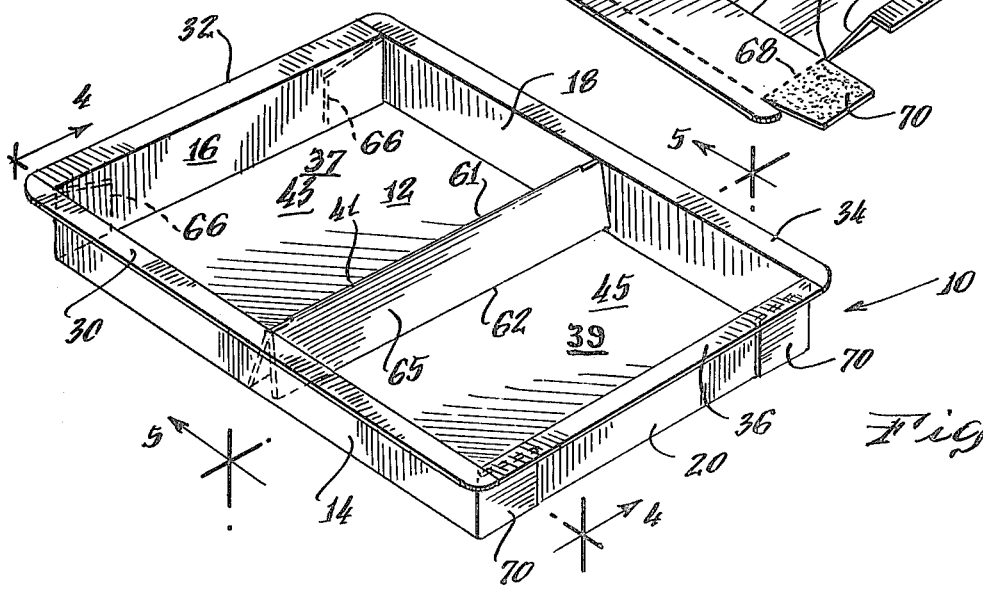
FIG. 3 is a perspective view of the fully erected divided food container of the present invention.
Figure 4:
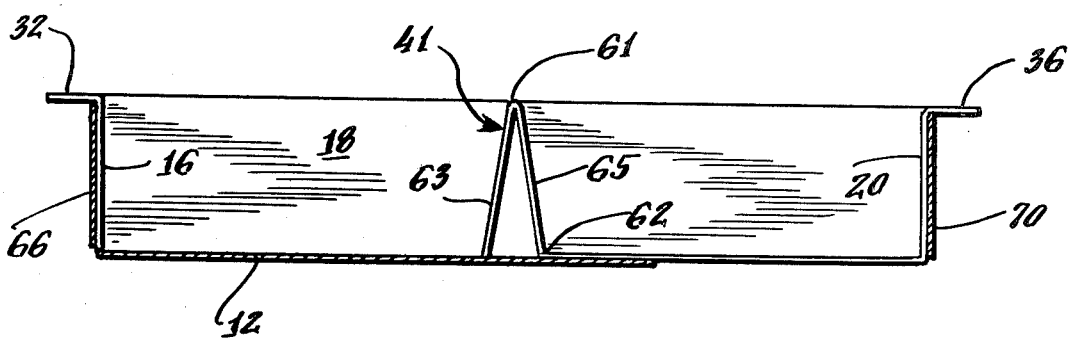
FIG. 4 is a cross-sectional view taken substantially along the plane indicated by line 4—4 of FIG. 3.
Figure 5:
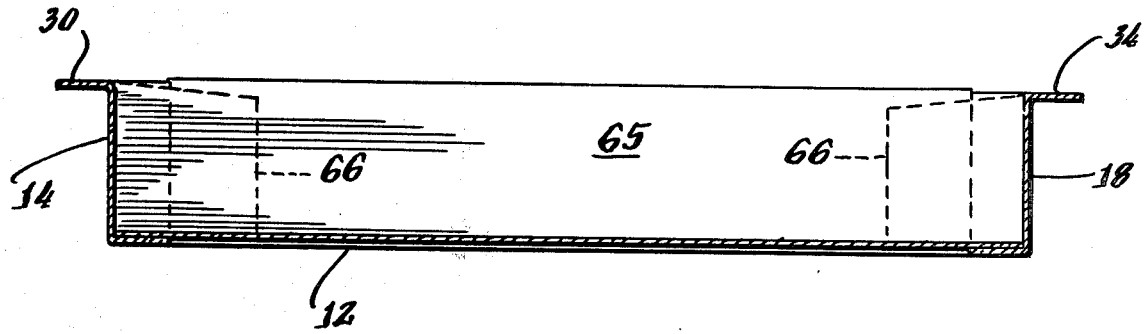
FIG. 5 is a cross-sectional view taken substantially along the plane indicated by line 5—5 of FIG. 3.

Referring now to the drawings in detail, wherein like numerals indicate like elements throughout the several views, a preferred embodiment of the paperboard tray 10 of the present invention is shown in FIG. 3 and includes a rectangular base 12. Upstanding walls 14, 16, 18 and 20 are hingedly portion connected to the base 12 by fold lines 22, 24, 26 and 28, respectively. The upstanding walls are vertically disposed.

Horizontal panels 30, 32, 34 and 36 are foldably connected to upstanding walls 14, 16, 18 and 20, respectively, by perforated score lines 38, 40, 42 and 44, respectively. The horizontal panels 30, 32, 34 and 36 form a peripheral flange for the tray 10 so as to receive a sealing lid to cover the contents of the tray.

An upright central divider wall 41 extends between walls 14 and 18 to divide base 12 into first and second portions 37 and 38 respectively which provide a pair of separate food compartments 43 and 45 for holding different food portions, e.g. a meat and a vegetable.

Figure 1:
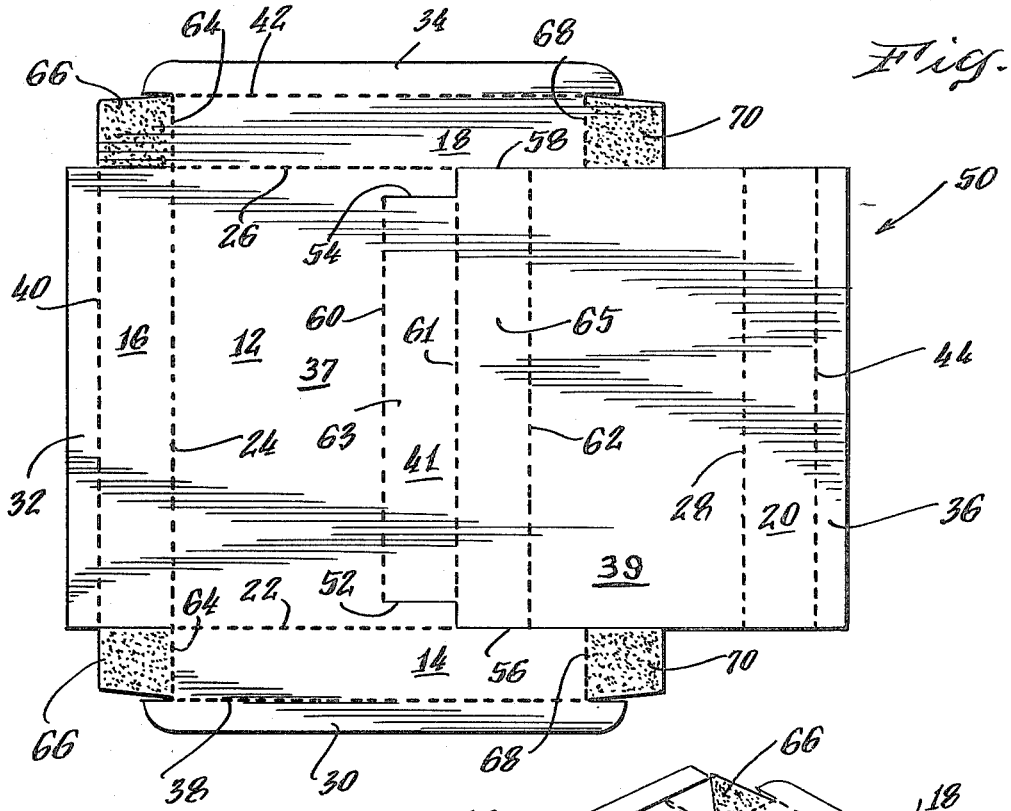
FIG. 1 is a plan view of a blank for forming the divided food container of the present invention.

Referring now to FIG. 1, a blank 50 for forming the tray 10 is shown. Blank 50 comprises a planar, paperboard sheet in which the second portion of the base 12 is die cut along parallel lines 52 and 54 disposed inwardly and parallel to the fold lines 22 and 26, and along parallel lines 56 and 58 contiguous to the fold lines 22 and 26, respectively. The top edge of the die cut second portion 39 of the base 12 is defined by a perforated score line 60 extending between the parallel die-cut lines 52 and 54. A perforated score line 62 is also provided parallel to the perforated score line 60 extending between the die cut edges 56 and 58.

Connected to the fold lines 22, 24 and 26 are rectangular panels 14, 16 and 18 forming three of the upstanding vertical side walls of the tray 10. Connected by the perforated score lines 38, 40 and 42 to the outer edges of each of the panels 14, 16 and 18 are the substantially rectangular panels 30, 32 and 34 forming three-fourths of the peripheral flange for the tray 10.

The fourth upright wall 20 is formed from a rectangular panel 20 connected by the fold line 28 to the lower edge of the die cut second portion 39 of the base 12. The fourth portion of the peripheral flange for the tray comprises a rectangular panel 36 connected by a perforated score line 44 to the rectangular lower panel 20 associated with the die cut second portion 39 of the base 12.

The central divider wall 41 is defined by the perforated score lines 60 and 62 and a fold line 61 intermediate and parallel to the score lines 60 and 62. The fold lines 60 and 61 form a rectangular panel 63, while the fold lines 61 and 62 form a rectangular panel 65 which when the tray 10 is erected are placed in abutment to form a hingedly connected two-panel or double thickness central divider wall 41.

Connected by a fold line 64 to the upper or lefthand edge of each of the lateral walls 14 and 18 is a closure tab 66. Similarly, connected by a fold line 68 to the lower or right-hand edge of each of the lateral panels 14 and 18 is a closure tab 70.

Figure 2:
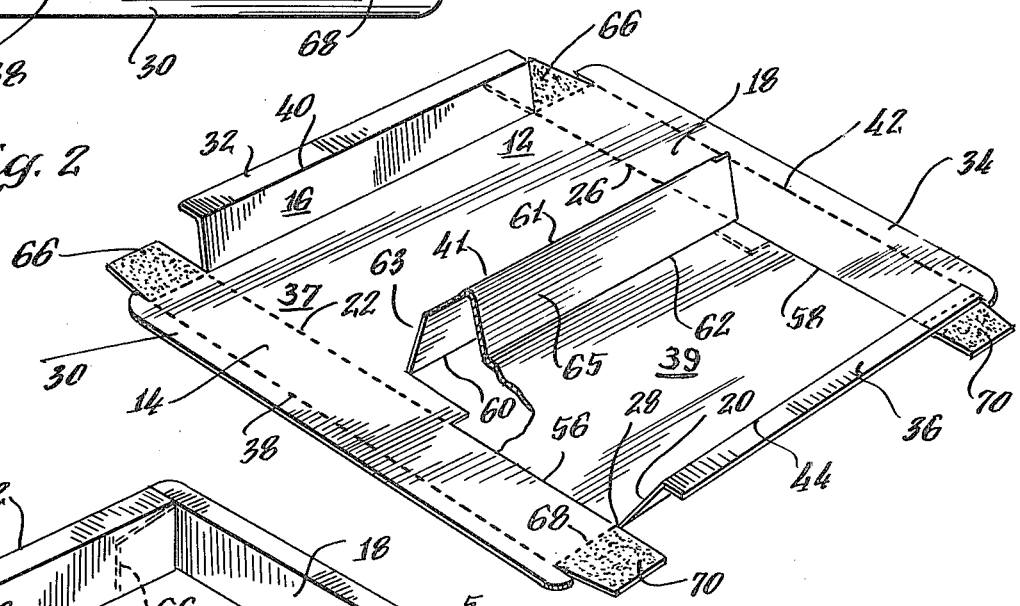
FIG. 2 is a perspective view of a partially erected blank of FIG. 1.

In erecting the blank 50 to form the tray 10, the die cut second portion 39 of the base 12 is first folded about fold line 61 and perforated score lines 60 and 62, as shown in FIG. 2, to form the upright central divider 41 extending vertically upright from planar rectangular base 12. This will align the fold line 28 with the fold lines 68 defining the lower edge of each of the lateral side wall panels 14 and 18.

The upright side walls 14, 16, 18 and 20 are then formed by rotating the panels 14, 16, 18 and 20, ninety degrees about its respective score line 22, 24, 26 and 28. The peripheral flange for the tray is then formed by rotating each of the panels 30, 32, 34 and 36 outwardly 90 degrees about fold lines 38, 40, 42 and 44 respectively. The corner closures 66 are then rotated 90 degrees about the fold line 64 and adhesively bonded to the exterior of the upright side wall 16. Similarly, corner closures 70 are rotated 90 degrees about fold lines 68 and adhesively bonded to the exterior surface of upright wall 20 to complete the tray construction. The opposite lateral edges of the flange panels 30, 32, 34 and 36 are shaped to abut so as to form a continuous peripheral flange.

Figure 6:
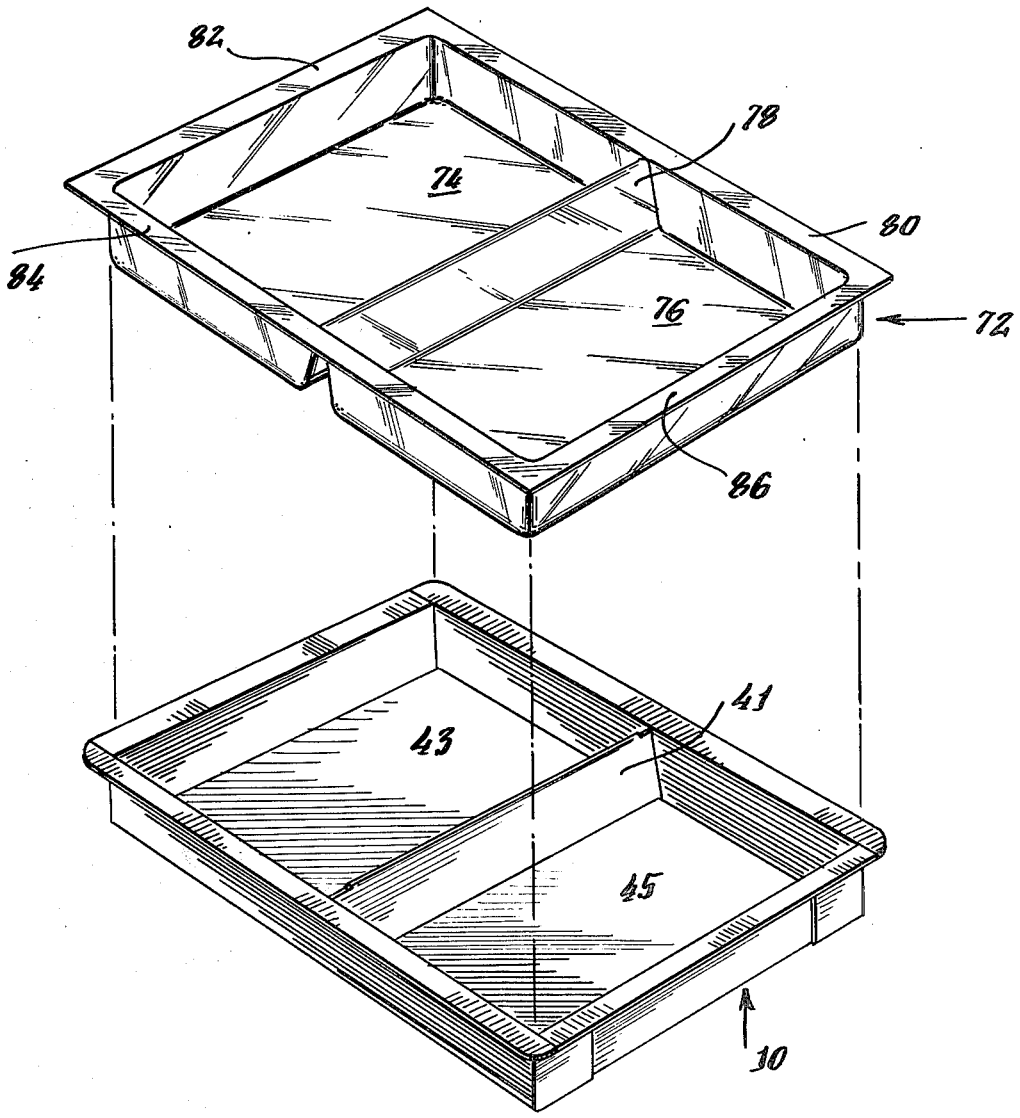
FIG. 6 is an exploded view showing the fully erected divided food container and its pre-formed liner.

Referring now to FIG. 6, the paperboard tray 10 described with reference to the foregoing figures is used in combination with a leakproof liner 72 comprising a pre-formed, semi-rigid blister of a thermoformable plastic material. Liner 72 generally conforms to the interior of tray 10 and includes first and second compartments 74 and 76 divided by an inverted V-shaped integral divider 78 which straddles the central divider wall 41 of tray 10. Liner 72 is formed with flanges 80, 82, 84 and 86 which rest on and are sealed to corresponding flanges on the tray 10 by heat sealing or suitable adhesives. Liner 72 may also optionally be sealed to the floor of one or both of the tray compartments 43 and 45. Since the paperboard tray provides adequate support, liner 72 can be semi-rigid in construction rather than rigid. This reduces the cost of the container combination relative to the cost of purely plastic containers.

The liner 72 conforms generally but not exactly to the interior of the tray. The edges and corners of the liner are slightly more rounded than the corresponding edges and corners of the tray to avoid tray areas in which food would be subjected to impinging microwave radiation from several different directions, resulting in overheating in such areas.

What is claimed as new is:

1. A compartmentalized container for packaging, storing and heating foods comprising:

a paperboard tray formed from a one piece foldable blank having a rectangular base, said base including first and second base members and a central divider wall being of inverted V-shaped configuration, with one side of said central divider wall being hingedly connected to the transverse side of said first base member adjacent thereto, and with the other side of said central divider wall being hingedly connected to the transverse side of said second base member adjacent thereto, with said central divider functioning to define a pair of discrete food compartments on said base;

a tubular side wall, said side wall including hingedly connected first and second opposed side wall members and first and second opposed end wall members;

said first end wall member being hingedly connected to the other transverse side of said first base member, said second end wall member being hingedly connected to the other transverse side of said second base member, said opposed side wall members being hingedly connected to the opposed longitudinal edges of said first base member;

said tray further including a horizontally disposed flange member hingedly connected to the top edge of said tubular side wall and extending perpendicularly therefrom; and a leak proof liner for said paperboard tray preformed from a semi-rigid blister of thermoformable material conforming generally to the interior of said paperboard tray, said blister being sealed to said tray along the flange member.

2. The container as recited in claim 1 wherein a pair of glued closure tabs are hingedly connected to the opposed ends of each said side wall member of said paperboard tray, said glued closure tabs being adhesively connected to the opposed ends of the associated end wall members, thereby providing a rigid closure of the tray.

3. For use in combination with a leak proof liner, preformed from a semi-rigid blister of thermoformable material, a blank for forming a compartmentalized food container comprising a substantially rectangular base, said base including first and second base members of substantially equal width and separated in the longitudinal direction by first and second divider members, with said second divider member being substantially identical in width to said second base member and hingedly connected thereto, with said first divider member being narrower in 'its' length then said second divider member and hingedly connected along one transverse edge thereto, said first divider member being hingedly connected along the other transverse edge thereof to said first base member, with the opposed longitudinally extending side edges of said first divider member being transversely spaced from the longitudinal sides of said rectangular base, and with said first base member adjacent the opposed longitudinally extending side edges of said first divider member extending to said second divider member, there being a pair of L-shaped cut lines running between said opposed longitudinally extending side edges of said first divider member and said first base member and extending between said first base member and said second divider member to the opposed longitudinal sides of said rectangular base, said cut lines aiding in the erection of said container, said blank further including a pair of opposed end wall members respectively hingedly connected to the opposed transverse sides of said base members; and a pair of opposed side wall members respectively hingedly connected to the opposed longitudinal sides of said first base member, said side wall members extending to a point intermediate the length of said second base member along the longitudinal sides thereof, said blank further including a first pair of opposed flange members respectively hingedly connected to the opposed end wall members, and a second pair of opposed flange members respectively hingedly connected to the opposed side wall members.

* * * * *

UNITED STATES PATENT AND TRADEMARK OFFICE

CERTIFICATE OF CORRECTION

PATENT NO. : 4,202,465

DATED : May 13, 1980

INVENTOR(S) : Edwin C. McLaren

It is certified that error appears in the above-identified patent and that said Letters Patent are hereby corrected as shown below:

Column 3, line 29, "portion" should not appear.

line 40, "38" should be "39".

Signed and Sealed this

*Second* Day of *September 1980*

[SEAL]

*Attest:*

SIDNEY A. DIAMOND

*Attesting Officer*

*Commissioner of Patents and Trademarks*